US007705273B2

(12) United States Patent
Hotta et al.

(10) Patent No.: US 7,705,273 B2
(45) Date of Patent: Apr. 27, 2010

(54) CERAMIC HEATER, METHOD OF PRODUCING THE SAME, AND GLOW PLUG USING A CERAMIC HEATER

(75) Inventors: Nobuyuki Hotta, Kohnan (JP); Katsura Matsubara, Iwakura (JP); Yoshihiro Yamamoto, Kitanagoya (JP); Masaya Ito, Nisshin (JP)

(73) Assignee: NGK Spark Plug Co., Ltd., Aichi (JP)

( * ) Notice: Subject to any disclaimer, the term of this patent is extended or adjusted under 35 U.S.C. 154(b) by 525 days.

(21) Appl. No.: 11/578,102

(22) PCT Filed: Apr. 6, 2005

(86) PCT No.: PCT/JP2005/006788

§ 371 (c)(1),
(2), (4) Date: Oct. 10, 2006

(87) PCT Pub. No.: WO2005/098317

PCT Pub. Date: Oct. 20, 2005

(65) Prior Publication Data

US 2007/0210053 A1 Sep. 13, 2007

(30) Foreign Application Priority Data

| | | |
|---|---|---|
| Apr. 7, 2004 | (JP) | P2004-112721 |
| Apr. 13, 2004 | (JP) | P2004-118117 |
| Jul. 6, 2004 | (JP) | 2004-199602 |

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/261, 262, 263, 264, 265, 267, 268, 269
See application file for complete search history.

(56) References Cited

U.S. PATENT DOCUMENTS

| | | | | |
|---|---|---|---|---|
| 6,744,015 | B2 * | 6/2004 | Tanaka et al. | 219/267 |
| 6,979,801 | B2 * | 12/2005 | Okazaki et al. | 219/270 |
| 7,034,253 | B2 * | 4/2006 | Yoshikawa et al. | 219/270 |

FOREIGN PATENT DOCUMENTS

| | | | |
|---|---|---|---|
| JP | 62-141423 | | 6/1987 |
| JP | 62-141423 | A | 6/1987 |
| JP | 2-20293 | U | 2/1990 |
| JP | 4-21093 | U | 2/1992 |
| JP | 5-285999 | A | 11/1993 |
| JP | 08-273813 | A | 10/1996 |
| JP | 2000-88248 | A | 3/2000 |

(Continued)

*Primary Examiner*—Daniel L Robinson
(74) *Attorney, Agent, or Firm*—Sughrue Mion, PLLC

(57) ABSTRACT

A ceramic heater in which a damage in a joining portion between a heating portion and a lead portion is suppressed and the reliability is excellent is provided.

In a ceramic heater (1) including: a rod-shaped support (2) which is made from an insulative ceramic; and a resistor member (3) including a heating portion (31) embedded in a tip end part of the support (2), and a pair of lead portions (33) which extend from the heating portion (31) toward a rear end side of the support (2), the heating portion (31) and the lead portions (33) are made from the same conductive ceramic.

15 Claims, 11 Drawing Sheets

FOREIGN PATENT DOCUMENTS

| | | | |
|---|---|---|---|
| JP | 2000-323263 | A | 11/2000 |
| JP | 2000-340350 | | 12/2000 |
| JP | 2000-340350 | A | 12/2000 |
| JP | 2001-280640 | | 10/2001 |
| JP | 2002-243150 | A | 8/2002 |
| JP | 2002-246153 | A | 8/2002 |
| JP | 2003-68433 | A | 3/2003 |
| JP | 2003-240240 | | 8/2003 |
| JP | 2004-61041 | | 2/2004 |
| JP | 2004-061041 | A | 2/2004 |

* cited by examiner

CERAMIC HEATER, METHOD OF PRODUCING THE SAME, AND GLOW PLUG USING A CERAMIC HEATER

TECHNICAL FIELD

The present invention relates to a ceramic heater, a method of producing the same, and a glow plug using the ceramic heater, and particularly to a ceramic heater which is suitable in a glow plug used for starting a diesel engine, a method of producing the same, and a glow plug using the same.

BACKGROUND ART

Conventionally, a sheath heater in which a heating coil embedded in insulating powder is placed in a bottomed cylindrical metal sheath is used for starting a diesel engine. In such a sheath heater, however, the thermal conductivity is low, and a long time is required for raising the temperature because the heating coil is embedded in the insulating powder. Recently, it is requested to raise the heating temperature of the heater to 1,000° C. or more, and the time period of afterglow in which the heater generates heats even after the engine is started tends to be prolonged. For the requests, a sheath heater has a problem in durability because the heating coil is made a metal.

Therefore, a ceramic heater has been developed in which a heating portion essentially comprising: a conductive ceramic material such as molybdenum carbide or molybdenum silicide; and an insulative ceramic component such as silicon nitride is embedded in a support made from silicon nitride ceramic that has highly corrosion resistant at a high temperature, whereby the thermal conductivity is improved and a rapid temperature rise is enabled.

An example in which, in such a ceramic heater, a lead portion to be connected to an internal heating portion is configured only by a metal wire such as tungsten (W), and that in which such a lead portion is configured by both a low-resistance ceramic material and a metal wire are disclosed (for example, see Patent References 1 and 2).

Patent Reference 1: JP-A-4-268112

Patent Reference 2: JP-A-2002-334768

DISCLOSURE OF THE INVENTION

Problems that the Invention is to Solve

In the production of a above-described ceramic heater, however, at least two kinds of materials, four kinds of materials at the maximum are required in addition to the support. A ceramic heater such as described above has a problem in that the difference in coefficient of thermal expansion between the heating portion and the lead portion causes a joining portion between the portions to easily crack.

The invention has been conducted so as solve the above-discussed problems. It is an object of the invention to provide a ceramic heater in which a damage in a joining portion between a heating portion and a lead portion is suppressed and the reliability is excellent, a method of producing it, and a glow plug using it.

Means for Solving the Problems

The ceramic heater of the invention is a ceramic heater having: a rod-shaped support which extends in an axial direction, and which is made from an insulative ceramic; and a resistor member configured by a heating portion embedded in a tip end part of the support, and a pair of lead portions comprising: one end which is connected to the heating portion; another end which is exposed from a rear end of the support; and a terminal part which is exposed from an outer peripheral face of the support wherein the heating portion and the lead portions are made from a same conductive ceramic.

As described above, the resistor member, i.e., the heating portion and the pair of lead portions are made from the same conductive ceramic, whereby a ceramic heater in which a damage in the joining portion due to the difference in coefficient of thermal expansion between the heating portion and the lead portion as in a conventional ceramic heater can be suppressed, and the reliability is excellent can be provided. In the resistor member, the heating portion and the lead portions may be separately produced by the same conductive ceramic, and thereafter joined together. In view of steps of joining them, the cost therefor, and the like, however, it is more preferable to integrally mold a resistor member configured by the heating portion and the lead portions.

In the ceramic heater of the invention, preferably, a maximum heating temperature per W is 18.4 to 30.0 (° C./W). In the ceramic heater of the invention, the heating portion and the lead portions are configured by the same conductive ceramic, and hence it is difficult to cause the tip end part which is a characteristic of the ceramic heater, to concentrically generate heat. However, the ceramic heater is configured as described above, and therefore heat generation can be concentrically efficiently conducted in the tip end part of the ceramic heater.

When the maximum heating temperature per W is less than 18.4 (° C./W), heat generation occurs in the whole ceramic heater, and it is difficult to cause the tip end part to concentrically generate heat. The volume of the heating portion which contributes to heat generation is relatively large as compared with the lead portion, the heating portion itself is damaged by thermal expansion at heat generation, and the energization durability may be lowered. Therefore, this is not preferable. Furthermore, the power consumption of the ceramic heater is large, and therefore the temperature of a portion where an electrode is led out becomes higher, and the reliability of the leading out of the electrode is lowered. Therefore, this is not preferable. When the heating temperature per W exceeds 30.0 (° C./W), heat generation is excessively concentrated to the tip end part of the ceramic heater, so that, when the ceramic heater is used for starting a glow plug, the starting property is lowered. The volume of the heating portion which contributes to heat generation is relatively small as compared with the lead portions, and therefore it is difficult to produce the heating portion.

The maximum heating temperature is measured on the ceramic heater by using a radiation thermometer. Furthermore, the maximum heating temperature per W is a value which is obtained by dividing the maximum heating temperature when the ceramic heater generates heat, by the power consumption at the time. In the case where the maximum heating temperature is 1,200° C. and the power consumption is 40 W, for example, the maximum heating temperature per W is 1,200 (° C.)/40 (W)=30 (° C./W). The power consumption is the power consumption of the whole resistor member 3 in the ceramic heater 1.

In the ceramic heater of the invention, preferably, a ratio of a resistance of a portion of the resistor member included in a range from a tip end of the support to ⅓ of a whole length of the support to a resistance of the resistor member is 0.48 to 0.80. According to the configuration, heat generation can be concentrically efficiently conducted in the tip end part of the ceramic heater. When the resistance ratio is less than 0.48, the above-mentioned maximum heating temperature per W easily becomes to be smaller than a predetermined value, this may cause reduction of the energization durability and increase of the power consumption. Therefore, this is not preferable. When the resistance ratio exceeds 0.80, the above-mentioned maximum heating temperature per W easily becomes to exceed the predetermined value, the starting property in the case where it is used in a glow plug is lowered, and it is difficult to produce the heating portion. Therefore, this is not preferable.

The terms "resistance of said resistor member" in the claims mean the resistance between two portions (between terminal parts, between electrode portions, or between terminal and electrode portions) disposed where the resistor member is exposed from the support. In case of three or more portions where the resistor member is exposed from the support, the terms mean a resistance between two portions which are actually used for supplying electricity to the heater.

In the ceramic heater of the invention, preferably, the resistance of the resistor member at 25° C. is equal to or smaller than 420 mΩ. When the resistance of the resistor member 3 at 25° C. is set to be 420 mΩ or less, a rapid temperature rise is enabled. When the resistance of the resistor member at room temperature is set to be 420 mΩ or less, for example, it is easy to obtain a ceramic heater which, in the case where a voltage of 11 V is applied, reaches 1,000° C. within 2 seconds. For example, the adjustment of the resistance of the resistor member at 25° C. may be conducted by adjusting the composition of the conductive ceramic constituting the resistor member, or by adjusting the sintering temperature when the resistor member is produced.

In the ceramic heater of the invention, preferably, a sectional area S1 of the heating portion is smaller than a sectional area S2 of the lead portions. When the sectional area S1 of the heating portion is smaller than the sectional area S2 of the lead portions in this way, only the tip end part of the ceramic heater can efficiently generate heat. The sectional areas S1, S2 of the heating portion and the lead portions are areas of sections which are perpendicular to a conduction path.

Preferably, a minimum sectional area S1 of the heating portion is in a range of 1/2.6 to 1/25.5 with respect to the sectional area S2 of the lead portions. According to the configuration, it is possible to obtain a ceramic heater in which the power consumption is suppressed, a rapid temperature rise is enabled, and sufficient energization durability is provided. In the case where the minimum sectional area S1 of the heating portion is smaller than 1/25.5 of the sectional area S2 of the lead portions, i.e., S1/S2<1/25.5, the sectional area of the heating portion occupied in a section perpendicular to the axial direction of the support is excessively small, so that the surface temperature of the support may be largely varied depending on the position, and temperature variation may occur in the ceramic heater. When the sectional area of the heating portion is reduced, it may be difficult to produce the heating portion. By contrast, when the minimum sectional area S1 of the heating portion exceeds 1/2.6 of the sectional area S2 of the lead portions, i.e., S1/S2>1/2.6, the sectional area of the heating portion is excessively large, so that the power consumption may be large. Furthermore, there arises the possibility that the coefficient of thermal expansion of the resistor member is larger than that of the support, the heating portion receives stress due to the difference in coefficient of thermal expansion, the heating portion is easily damaged, and the energization durability is lowered.

In the invention, the sectional area of the heating portion of the resistor member is not necessarily identical over the range from one end part to the other end part. A different sectional area may be included as far as the minimum area is included in the above-mentioned sectional area ratio.

In the ceramic heater of the invention, preferably, the heating portion has a pair of connecting portions which extend in an axial direction, and which are connected respectively to the pair of lead portions, and a center axis of one of the connecting portions is positioned outside a center axis of one of the lead portions which is continuous to the connecting portion. According to the configuration, the heating portion is closer to the outer periphery of the support, so that the heat generated in the heating portion can be efficiently transmitted to the outer surface of the ceramic heater, and heat is efficiently generated in the tip end part of the ceramic heater.

Usually, a resistor member of such a ceramic heater is produced by injection molding. When such a resistor member is to be produced by injection molding, a pair of upper and lower molding dies (metal molds) in which a cavity (recess) corresponding to the resistor member is formed in a die matching face (die closing face) are used. In the production of such a resistor member, a material (row material) for forming the resistor member is injected into the cavity formed by closing the upper and lower molding dies, and, after solidification, the dies are opened to take out the resistor member. At this time, in order to smoothly separate and removes away the resistor member from the molding die (inner face), a molding die in which ejector pins (columnar pushing pins) for ejecting the resistor member are placed is used. In the die opening, the ejector pins are pushed toward the cavity, and the resistor member is slightly separated from the bottom face of the cavity.

In order to surely separate the resistor member from the inner face of the cavity and smoothly take out it, the ejector pins must be disposed so as to be adequately distributed over the whole resistor member. Sometimes, the ejector pins are disposed also in the heating portion in addition to the lead portions of the resistor member. At this time, also the ejector pins which butt against the heating portion must be thinned. As ejector pins are thinner, deformation and damages (buckling and bending) occur more easily. Therefore, it may be contemplated that the resistor member is taken out from the molding die without causing the ejector pins to butt against the heating portion. However, there may arise a problem such as that the heating portion cannot be smoothly separated from the face of the molding die to cause the heating portion to buckle or deform, or that a crack occurs in a root part of the portion.

Therefore, the ceramic heater of the invention has, in a part of the heating portion, a flat part in which a width w of the heating portion in a section of the heating portion is larger than a thickness h of the heating portion perpendicular to the width, and larger than a width of another portion of the heating portion. When a flat part is disposed in a part of the heating portion in this way, the ejector pins can butt against the flat part. When the resistor member is to be taken out from the molding die, therefore, the resistor member can be easily separated from the face of the molding die, and a phenomenon that the heating portion buckles or deforms, or that a crack occurs in a root part of the portion can be suppressed. Furthermore, it is not necessary to thin the ejector pins, and therefore also deformation or damage of the ejector pins can be suppressed. As an example of the flat part, a part comprising a projection which is formed by partly raising the heating portion to project to the outside may be employed.

In the ceramic heater of the invention, when the heater is cut by a section passing center axes of the lead portions, preferably, the projection is disposed inside the heating portion. When the projection is disposed inside the heating portion in this way, the heating portion is closer to the outer periphery of the support, the heat generated in the heating portion can be efficiently transmitted to the outer surface of the ceramic heater, and heat is efficiently generated in the tip end part of the ceramic heater.

The ceramic heater of the invention can be used as a glow plug. In this case, preferably, the glow plug has: a metal outer tube which allows the heating portion of the ceramic heater to be projected, and which circumferentially surrounds the heating portion; and a metal shell which allows a tip end side of the metal outer tube to be projected, and which holds the metal outer tube, and an axial distance D between a rear end of the heating portion and a tip end face of the metal outer tube is equal to or longer than 2 mm. In a glow plug, recently, a heating portion tends to be placed closer to the tip end in order to perform heating in an inner position of a combustion chamber, and therefore the length of the ceramic heater in the longitudinal direction tends to be lengthened. Then, a problem arises in strength of the ceramic heater. The use of the metal outer tube maintains the strength of the ceramic heater. When the distance D is equal to or larger than 2 mm, removal which is conducted by the metal outer tube on heat generated from the heating portion of the ceramic heater can be suppressed, and heating can be efficiently performed. When the distance D is smaller than 2 mm, heat generated from the heating portion is removed away by the metal outer tube, with the result that the temperature rise of the glow plug is delayed, and the power consumption for heating to a predetermined temperature is increased.

The method of producing of a ceramic heater of the invention is a method of producing of a ceramic heater having: a rod-shaped support which is made from an insulative ceramic; and a resistor member configured by a heating portion embedded in a tip end part of the support, and a pair of lead portions which extend from the heating portion toward a rear end side of the support, wherein a sectional area S1 of the heating portion is smaller than a sectional area S2 of the lead portions, a part of the heating portion has a flat part in which a width w of the heating portion in a section of the heating portion is larger than a thickness h of the heating portion perpendicular to the width, and the method comprises: a step (molding step) of injection molding an unsintered resistor member by using molding dies, the unsintered resistor member being made from a same conductive ceramic material, and formed as the resistor member after sintering; a step (releasing step) of butting ejector pins against, in the unsintered resistor member, an unsintered flat part which is formed as the flat part after sintering and unsintered lead portions which are formed as the lead portions after sintering, thereby removing from the molding dies; a step (embedding step) of embedding the unsintered resistor member in an unsintered support which is formed as the support after sintering; and a step (sintering step) of sintering the unsintered support in which the unsintered resistor member is embedded.

In the configuration where, in the releasing step, the ejector pins are butted against the unsintered flat part and the unsintered lead portions to be pushed out from the molding die, whereby, when the unsintered resistor member is to be taken out from the molding die, the unsintered resistor member can be easily separated from the face of the molding die, and a phenomenon that the unsintered heating portion buckles or deforms, or that a crack occurs in a root part of the portion can be suppressed.

In the method of producing of a ceramic heater of the invention, preferably, the ejector pins include: a first ejector pin which is closest to the unsintered heating portion among the ejector pins that are to butt against the unsintered lead portions; a second ejector pin which is to butt against the unsintered flat part that is adjacent to the first ejector pin; and a third ejector pin which butts against the unsintered lead portion that is adjacent to the first ejector pin, and an axial distance between the first ejector pin and the second ejector pin is shorter than an axial distance between the first ejector pin and the third ejector pin. According to the configuration, with respect to the unsintered heating portion having a small sectional area, the ejector pins can be placed with a reduced interval. When the unsintered resistor member is to be taken out from the molding die, the unsintered resistor member can be easily separated from the face of the molding die, and a phenomenon that the unsintered heating portion buckles or deforms, or that a crack occurs in a root part of the portion can be suppressed.

DESCRIPTION OF REFERENCE NUMERALS AND SIGNS

1 . . . ceramic heater, 2 . . . support, 3 . . . resistor member, 31 . . . heating portion, 33 . . . lead portion, 4 . . . projection, 200 . . . glow plug

BEST MODE FOR CARRYING OUT THE INVENTION

Hereinafter, the invention will be described with reference to the drawings.

Figure 1:
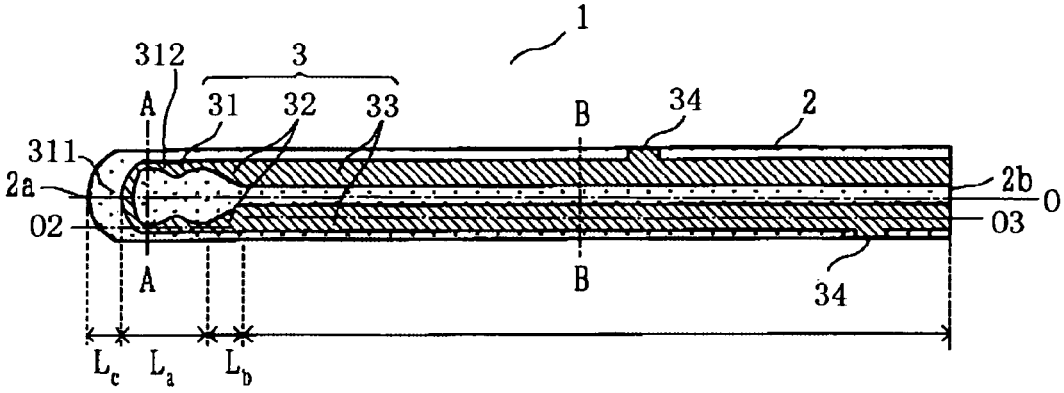
FIG. 1 is a section view showing an example of the ceramic heater of the invention.

FIG. 1 is a section view showing an example of the ceramic heater 1 of the invention. In the ceramic heater 1 of the invention, a resistor member 3 is embedded in a rod-shaped support 2 which extends in the direction of the axis O. The support 2 is made from an insulative ceramic. One of the ends is a tip end 2*a* (the left side of FIG. 1), and the other end is a rear end 2*b* (the right side of FIG. 2).

An example of the insulative ceramic constituting the support 2 is silicon nitride ceramic. The structure of silicon nitride ceramic has a form in which main-phase particles essentially comprising silicon nitride (Si3N4) are coupled together by the grain boundary phase due to sintering auxiliary components which will be described later, and the like. The main phase may be substitution of a part of Si or N with Al or O, or solid solution of a metal atom such as Li, Ca, Mg, or Y in a phase.

For example, sialons expressed by the following formulae are exemplified:

β-sialon: Si6-zAlzOzN8-Z (z=0 to 4.2)

α-sialon: Mx(Si, Al)12(O, N)16 (x=0 to 2)

M: Li, Mg, Ca, Y, or R (R is a rear-earth element excluding La and Ce).

In the silicon nitride ceramic, at least one selected from the element groups of 3A, 4A, 5A, 6A, 3B (for example, Al), and 4B (for example, Si) groups in the periodic table, and Mg may be contained as the cation element by 1 to 10 mass % in terms of oxide in the content of the whole sintered body. These components are added mainly in the form of oxides, and, in a sintered body, contained mainly in the form of oxides or compound oxides such as silicate.

When the sintering auxiliary component is less than 1 mass %, it is difficult to obtain a dense sintered body. When the sintering auxiliary component exceeds 10 mass %, insufficiency of strength, toughness, and heat resistance will occur. Preferably, the content of the sintering auxiliary component is 2 to 8 mass %. When a rear-earth element is used as the sintering auxiliary component, Sc, Y, La, Ce, Pr, Nd, Sm, Eu, Gd, Tb, Dy, Ho, Er, Tm, Yb, or Lu may be used. Among these elements, Tb, Dy, Ho, Tm, and Yb have effects of expediting crystallization of the grain boundary phase and improving the high-temperature strength, and therefore may be preferably used.

When heating is performed at a high temperature, particularly, it is desirable to reduce the content of Mg or Al of the silicon nitride ceramic as far as possible. More preferably, entering of elements of 1A and 2A groups as inevitable impurities in the used materials or the production process must be reduced as far as possible.

Referring again to FIG. 1, the resistor member 3 which is embedded in the support 2 is configured by a heating portion 31, a pair of connecting portions 32, and a pair of lead portions 33. The heating portion 31 has a U-like shape configured by a folded part 311 and a pair of connecting parts 312. The folded part 311 is embedded in the vicinity of a tip end 2*a* of the support 2. The tip ends of the pair of connecting parts 312 are coupled to the both ends of the folded part 311, respectively. The pair of connecting parts 312 are extended in the direction of the axis O. The rear ends of the pair of connecting parts 312 are connected to the tip ends of the pair of connecting portions 32, respectively. The connecting portions 32 have a tapered shape in which the diameter is more increased as advancing from the tip end 2*a* to the rear end 2*b*. The rear ends of the pair of the connecting portions 32 are coupled to the pair of lead portions 33, respectively. The other ends of the lead portions 33 are elongated so as to be exposed from the rear end 2*b* of the support 2. Terminal parts 34 are disposed in the pair of lead portions 33 so as to be exposed from the outer peripheral face of the support 2.

In the ceramic heater 1, the heating portion 31, the connecting portions 32, the lead portions 33, and the terminal parts 34 which constitute the resistor member 3 are made from the same conductive ceramic. Examples of the conductive ceramic are ceramics of tungsten carbide (WC), molybdenum disilicide (MoSi2), tungsten disilicide (WSi2), etc.

When the resistor member 3, i.e., the heating portion 31 and the pair of lead portions 33 are made from the same conductive ceramic as described above, a ceramic heater in which a damage in the joining portion due to the difference in coefficient of thermal expansion between the heating portion and the lead portion as in a conventional ceramic heater can be suppressed, and the reliability is excellent can be provided.

The conductive ceramic constituting the resistor member 3 may contain a ceramic material constituting the support 2, such as the above-mentioned silicon nitride ceramic in order to reduce the difference in linear coefficient of expansion with respect to the support 2 and enhance the thermal shock resistance. When the content ratio of the insulative ceramic content in the conductive ceramic is changed, it is possible to adjust the electrical resistivity of the conductive ceramic to a desired value.

Specifically, the insulative ceramic content contained in the conductive ceramic is preferably 50 weight % or less. When the insulative ceramic content contained in the conductive ceramic exceeds 50 weight %, sufficient heat generation cannot be ensured, and hence this is not preferable.

More preferably, the content of the insulative ceramic content in the conductive ceramic is 20 to 50 weight %. When the content of the insulative ceramic content in the conductive ceramic is set in the range, the difference in linear coefficient of expansion with respect to the support 2 can be reduced to enhance the thermal shock resistance.

In the embodiment, the maximum heating temperature per W of the ceramic heater 1 is 26.5 (° C./W). Since the maximum heating temperature per W is 18.4 to 30.0 (° C./W), heat generation can be concentrically efficiently conducted in the tip end part of the ceramic heater 1.

In the ceramic heater 1 of the embodiment, the ratio of the resistance (R2) of a part (L2) of the resistor member 3 included in the range from the tip end 2*a* of the support 2 to ⅓ of the whole length (L1) of the support to the resistance (R1) of the resistor member 3 is 0.53. Since the resistance ratio (R2/R1) is 0.48 to 0.80 in this way, heat generation can be concentrically efficiently conducted in the tip end part of the ceramic heater.

In the ceramic heater 1 of the embodiment, the resistance (R1) of the resistor member 3 at 25° C. is 330 mΩ. When the resistance (R1) of the resistor member 3 at 25° C. is set to be 420 mΩ or less, a rapid temperature rise is enabled.

In the embodiment, when the length (La) of the heating portion 31 of the resistor member 3 is the length in the direction of the axis O from the most tip end side of the folded part 311 to a rear end side part of the heating portion 31 (the interface parts of the heating portion 31 and the connecting portions 32), the length (La) of the heating portion is 3.4 mm. In this way, it is preferable to set the length (La) of the heating portion 31 to be equal to or larger than 1 mm and equal to or smaller than 10 mm. When the length (La) of the heating portion 31 is smaller than 1 mm, the volume of the heating portion 31 is so small that heat is removed by the support 2, with the result that the temperature rise is delayed, and the power consumption for heating to a predetermined temperature is increased. Therefore, this is not preferable. When the length (La) of the heating portion 31 is longer than 10 mm, conversely, the volume of the heating portion 31 is excessively large. Therefore, a wide range of the ceramic heater 1 which is more than necessary generates heat, and the power consumption is increased also in this case.

In the embodiment, when the length in the direction of the axis O from the interface parts of the heating portion 31 and the connecting portions 32 to the interfaces of the connecting portions 32 and the lead portions 33 is the length (Lb) of the connecting portions 32, the length (Lb) of the connecting portions 32 is 1.6 mm. It is preferable to set the length (Lb) of the connecting portions 32 to be equal to or larger than 1 mm and equal to or smaller than 10 mm. When the length (Lb) of the connecting portions 32 is smaller than 1 mm, the connecting portions 32 are so short that the strength is insufficient, and there is the possibility that breakage occurs between the heating portion 31 and the lead portions 33. By contrast, when the length (Lb) of the connecting portions 32 is longer than 10 mm, the length of the connecting portions 32 is excessively long, and there is the possibility that a large power is consumed in the connecting portions 32.

In the embodiment, the distance (Lc) in the direction of the axis O from the tip end 2*a* of the support 2 to the most tip end side of the folded part 311 of the resistor member 3 is 1 mm. Preferably, the embedding is performed so that the distance (Lc) is equal to or larger than 0.2 mm and equal to or smaller than 1.0 mm. When the distance (Lc) is smaller than 0.2 mm, the possibility that the resistor member 3 is exposed from the tip end 2*a* of the support 2 is high, and hence the resistor member 3 may be possibly oxidized and broken. By contrast, when the distance is longer than 1.0 mm, there is the possibility that heat generation hardly occurs in the tip end 2*a*, and the temperature rise is delayed.

The total length and diameter of the ceramic heater 1 are not particularly restricted. In a usual form, the ceramic heater has a round-rod like shape of the total length of 30 mm or more and 50 mm or less, and the diameter of 2.5 mm or more and 4.0 mm or less. For example, the minimum thickness of the surface layer of the support 2 is 100 μm or more and 500 μm or less.

The center axis O2 of each of the connecting parts 312 of the heating portion 31 is positioned outside the center axis O3 of the corresponding one of the lead portions 33. When the center axis O2 of one of the connecting parts 312 is positioned outside the center axis O3 of the one of the lead portions 33 which is continuous to the connecting part 312, the heating portion 31 is closer to the outer periphery of the support 2, so that the heat generated in the heating portion 33 can be efficiently transmitted to the outer surface 1*a* of the ceramic heater, and heat is efficiently generated in the tip end part of the ceramic heater 1.

Figure 2:
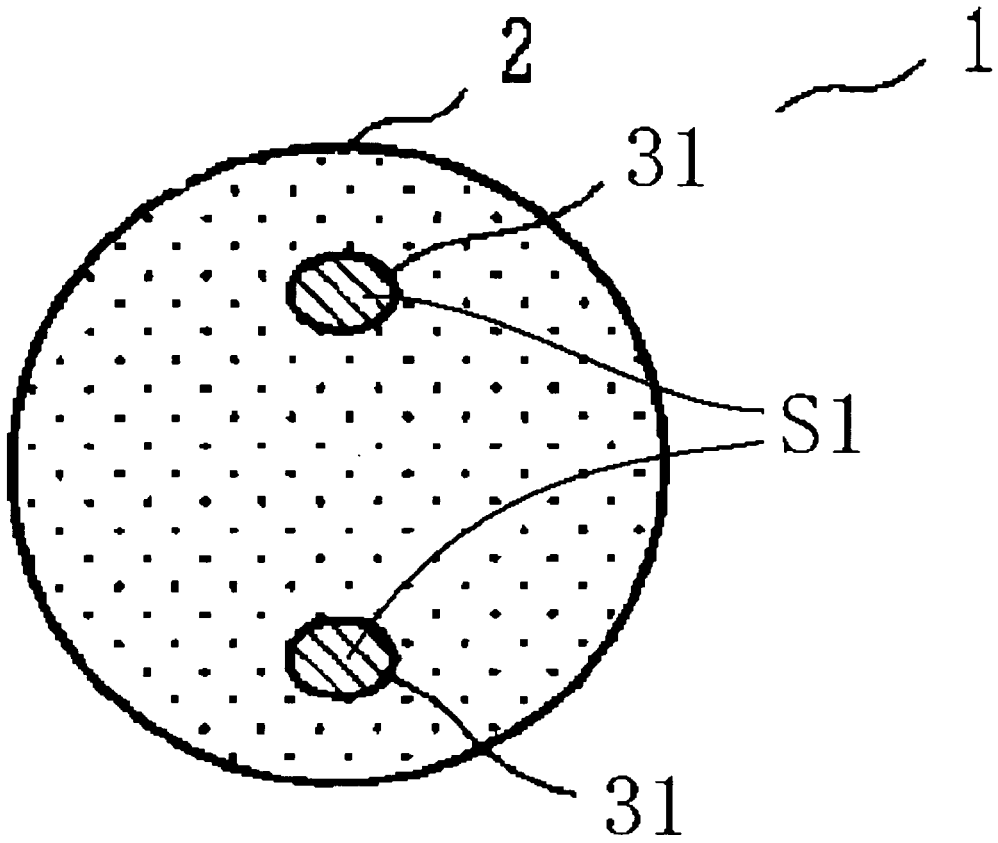
FIG. 2 is a section view showing a section A-A in FIG. 1.
Figure 3:
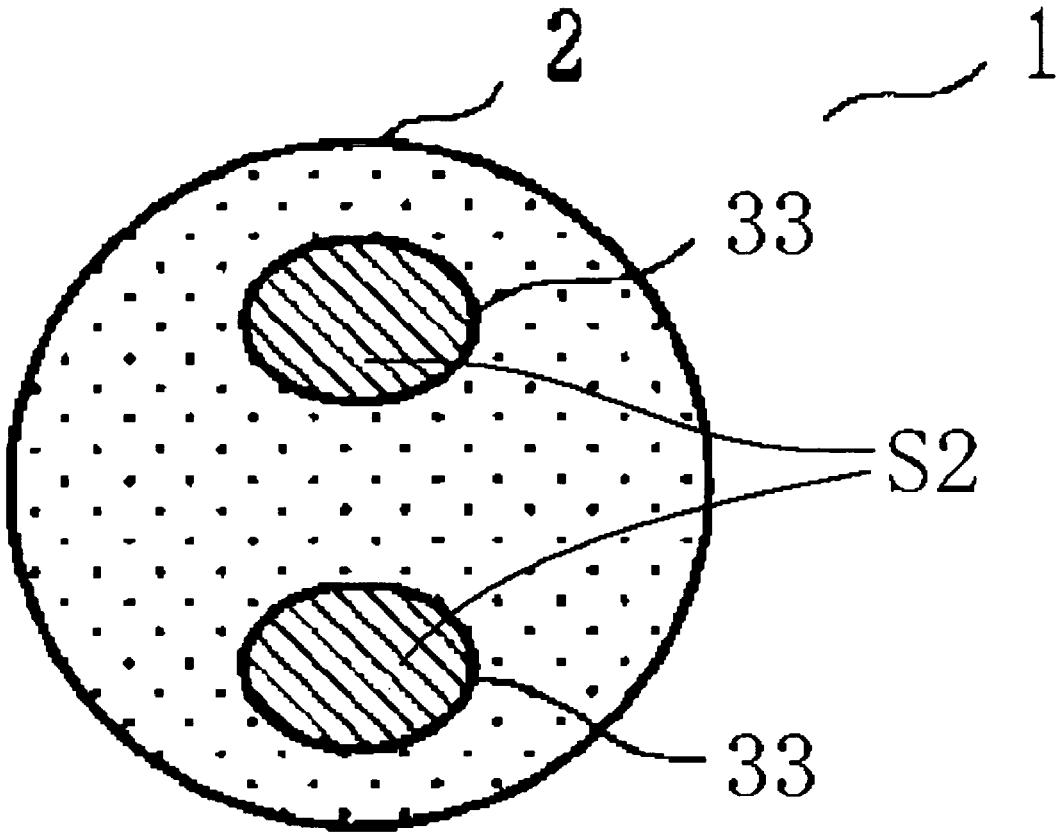
FIG. 3 is a section view showing a section B-B in FIG. 1.

FIG. 2 is a section view showing a section A-A which is a section including the heating portion 31 (the connecting part 312) in the ceramic heater 1 shown in FIG. 1, and FIG. 3 is a section view showing an example of a section view of a section B-B which is a section including the lead portions 33. The A-A section view is obtained by taking along the minimum section of the heating portion 31. As apparent from FIGS. 2 and 3, the sectional area S1 of the heating portion 31 is formed so as to be smaller than the sectional area S2 of the lead portions 33. When the sectional area S1 of the heating portion 31 is smaller than the sectional area S2 of the lead portions 33 in this way, only the tip end part of the ceramic heater can efficiently generate heat. The section shapes of the heating portion 31 and the lead portions 33 are oval.

In the embodiment, the sectional area S1 of the heating portion 31 of the resistor member 3 is 0.48 $mm^2$, and the sectional area S2 of the lead portions 33 of the resistor member 3 is 1.68 $mm^2$. When the small-diameter portion 3*a* of the resistor member 3 in the ceramic heater 1 is adjusted to be in the range of 1/2.6 to 1/25.5 of the sectional area of the large-diameter portion 3*c* as described above, it is possible to obtain a ceramic heater in which the power consumption is suppressed, a rapid temperature rise is enabled, and sufficient energization durability is provided.

Figure 4:
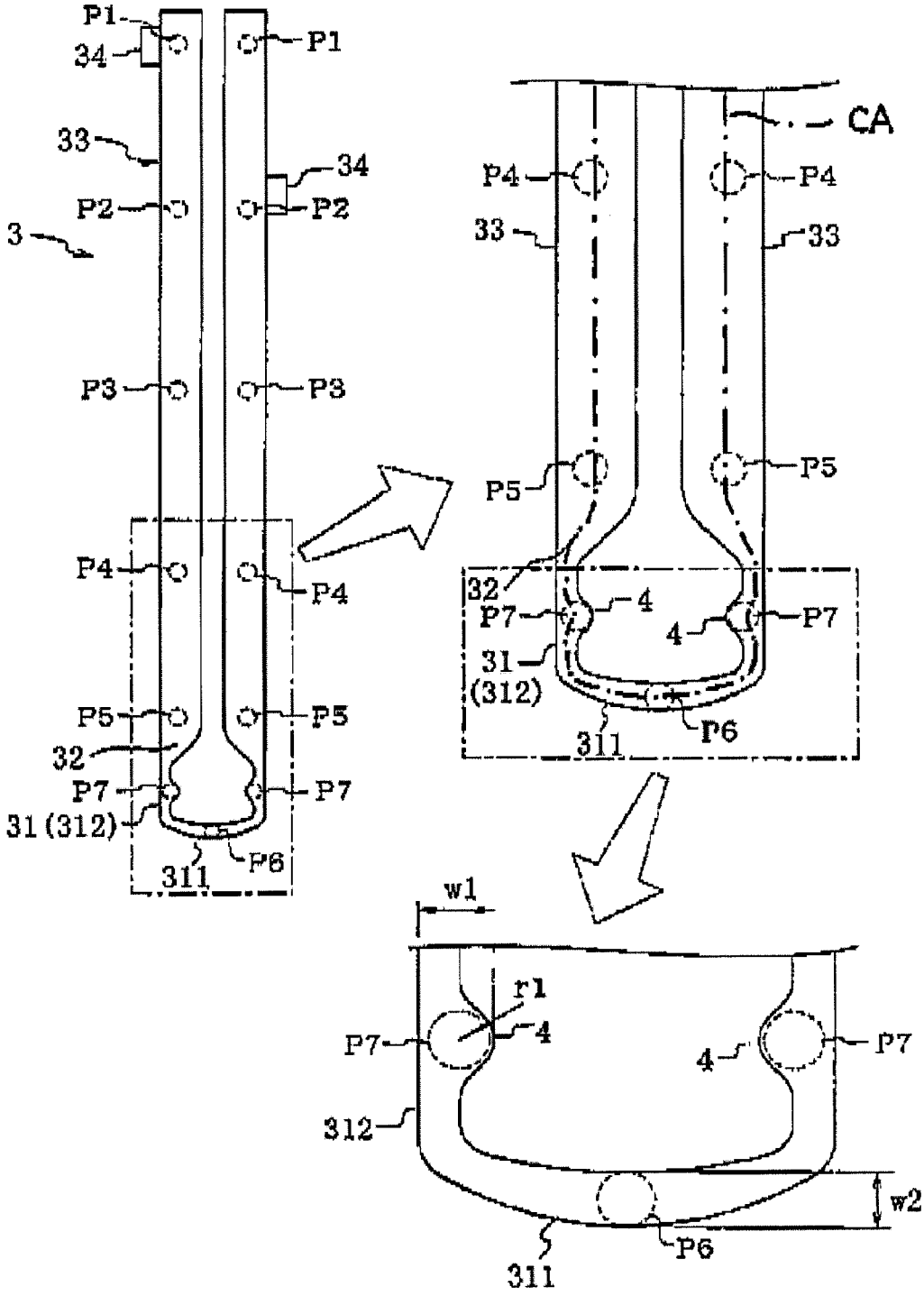
FIG. 4 is a front view (plan view) of a first embodiment of a resistor member of the invention, an enlarged view of main portions, and a further enlarged partial view of the enlarged view of main portions.

FIG. 4 is an enlarged view which is obtained by extracting and expanding only the resistor member 3 of the ceramic heater 1 of FIG. 1. Although described in detail later, circular portions P1 to P7 indicated by broken lines in FIG. 4 are positions against which ejector pins (tip end faces) T1 to T7 that, after an unsintered resistor member 103 that is the resistor member 3 in an unsintered state is produced by injection molding, are used for removing the unsintered resistor member from the molding dies are to butt. As shown in FIG. 4, in the resistor member 3, a semi-arcuate projection 4 is inflatingly formed in an inward-inflating shape in a portion which is positioned inside at the middle of the connecting parts 312 of the heating portion 31. Although the projection 4 has a semi-circular shape in FIG. 4, the thickness is set to be identical with the diameter of the connecting parts 312. The thickness h1 of the connecting parts 312 in the embodiment is thinned, for example, 0.56 mm, the radius r1 of the arc of the projection 4 is 0.4 mm, and the width w1 of the connecting parts 312 in the portion where the projection 4 exists is 0.9 mm. Therefore, it is set so that the tip end face of the columnar ejector pin T7 having a diameter of, for example, 0.8 mm can butt against the portion (the circular portion P7 of the broken line in FIG. 4) of the connecting parts 312 which corresponds to the projection 4. The width w2 of a middle portion of the folded part 311 is 0.8 mm. It is set so that, against the circular portion P6 of the broken line indicated therein, the tip end face of the columnar ejector pin T6 having a diameter of 0.8 mm can butt. In the ridge line between the semi-circular plane of the projection 4 and the semi-arcuate peripheral face, a chamfer of an adequately small radius is provided in order not to form an edge.

In this way, as a part of the heating portion 31, the ceramic heater 1 has the projection 4 (flat part) in which the width w1, w3 of the heating portion 31 in a section of the heating portion 31 is longer than the thickness h perpendicular to the width of the heating portion 31. When the projection 4 is disposed in a part of the heating portion 31 in this way, it is possible to cause the ejector pins T6, T7 to butt against the projection 4. When the unsintered resistor member 103 is to be taken out from the molding die, therefore, the unsintered resistor member 103 can be easily separated from the face of the molding die, and a phenomenon that the heating portion 31 buckles or deforms, or that a crack occurs in a root part of the portion can be suppressed. Furthermore, it is not necessary to thin the ejector pins T6, T7, and therefore also deformation or damage of the ejector pins can be suppressed.

In the ceramic heater 1, when the heater is cut by a section passing the center axes O2, O3 of the lead portion 33, the projection 4 is disposed inside the heating portion 31. When the projection 4 is disposed inside the heating portion 31 in this way, the heating portion 31 is closer to the outer periphery of the support 2, the heat generated in the heating portion 31 can be efficiently transmitted to the outer surface 1*a* of the ceramic heater, and heat is efficiently generated in the tip end part of the ceramic heater 1.

Figure 5:
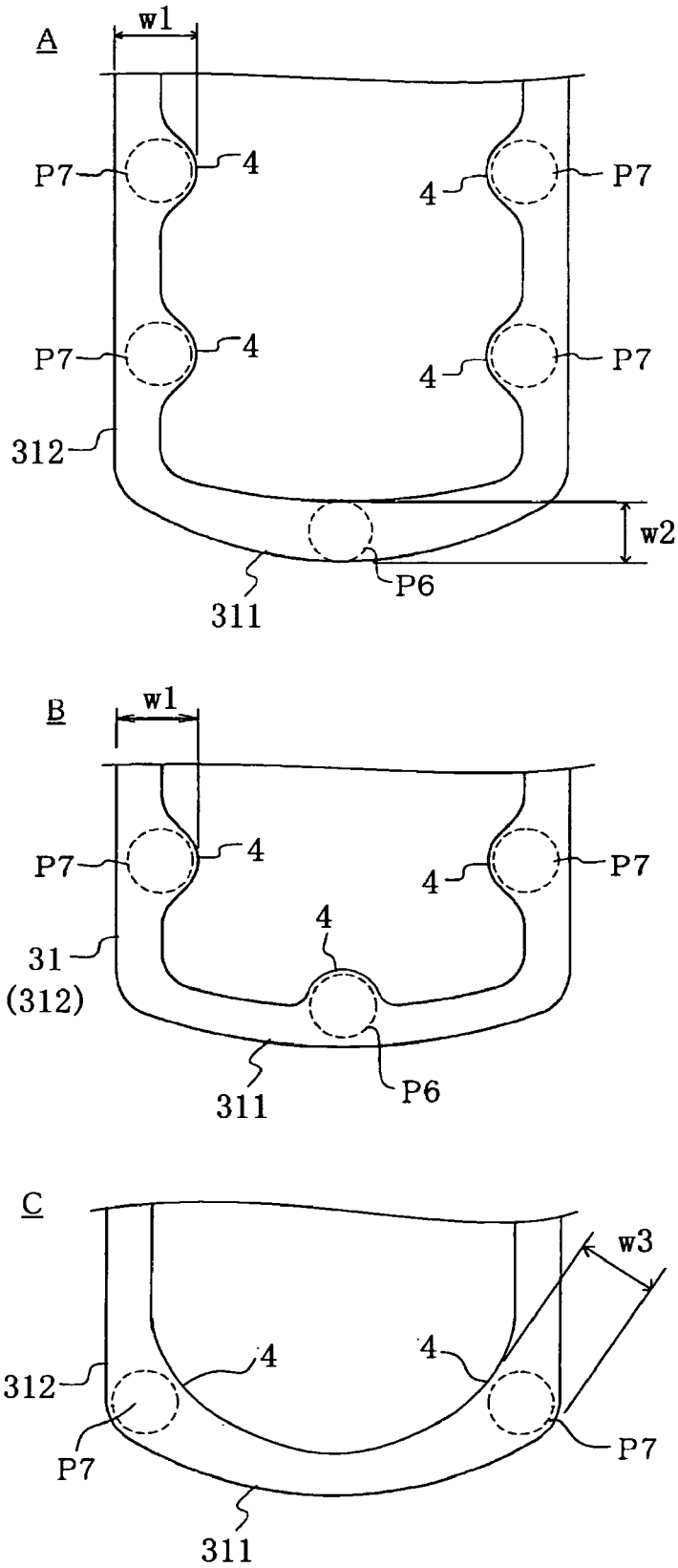
FIG. 5 is a front view (plan view) of another example of the resistor member, and an enlarged view of main portions.

The invention is not restricted to the above-described contents, and may be practiced in adequately modified manners without departing the spirit and scope of the invention. For example, the projection 4 disposed in the heating portion 31 can prevent a disadvantage such as breakage in releasing by the pins in accordance with the thickness and length of the heating portion 31. FIG. 5 shows a modification of the heating portion 31 of FIG. 4. In FIG. 5-A, the projection 4 is disposed in plural places of the connecting parts 312 of the heating portion 31. Although two places are shown in FIG. 5-A, many projections may be formed in the form where concave and convex portions are continuous. In FIG. 5-B, the folded part 311 has a constant width which is smaller than the diameter of the pin T6, and the projection 4 is disposed in the middle of the part.

The form of the projection 4 is not restricted to an arcuate shape. In FIG. 5-C, for example, the projection 4 (flat part) is disposed in the connecting portions of the folded part 311 of the heating portion 13 and the connecting parts 312. The width w3 in this case is measured in the illustrated manner. The value of w3 is 0.9 mm, and the thickness h3 is 0.56 mm. In this way, the flat part may have a thickness at which the butting of the ejector pins is enabled, and, in this case, releasing is enabled without producing breakage or the like in the heating portion 31. It may be adequately set in accordance with the relationship between the desired resistance of the resistor member 3 and the length of the heating portion 31, and that of the number of the projections 4 and the pitch.

Figure 6:
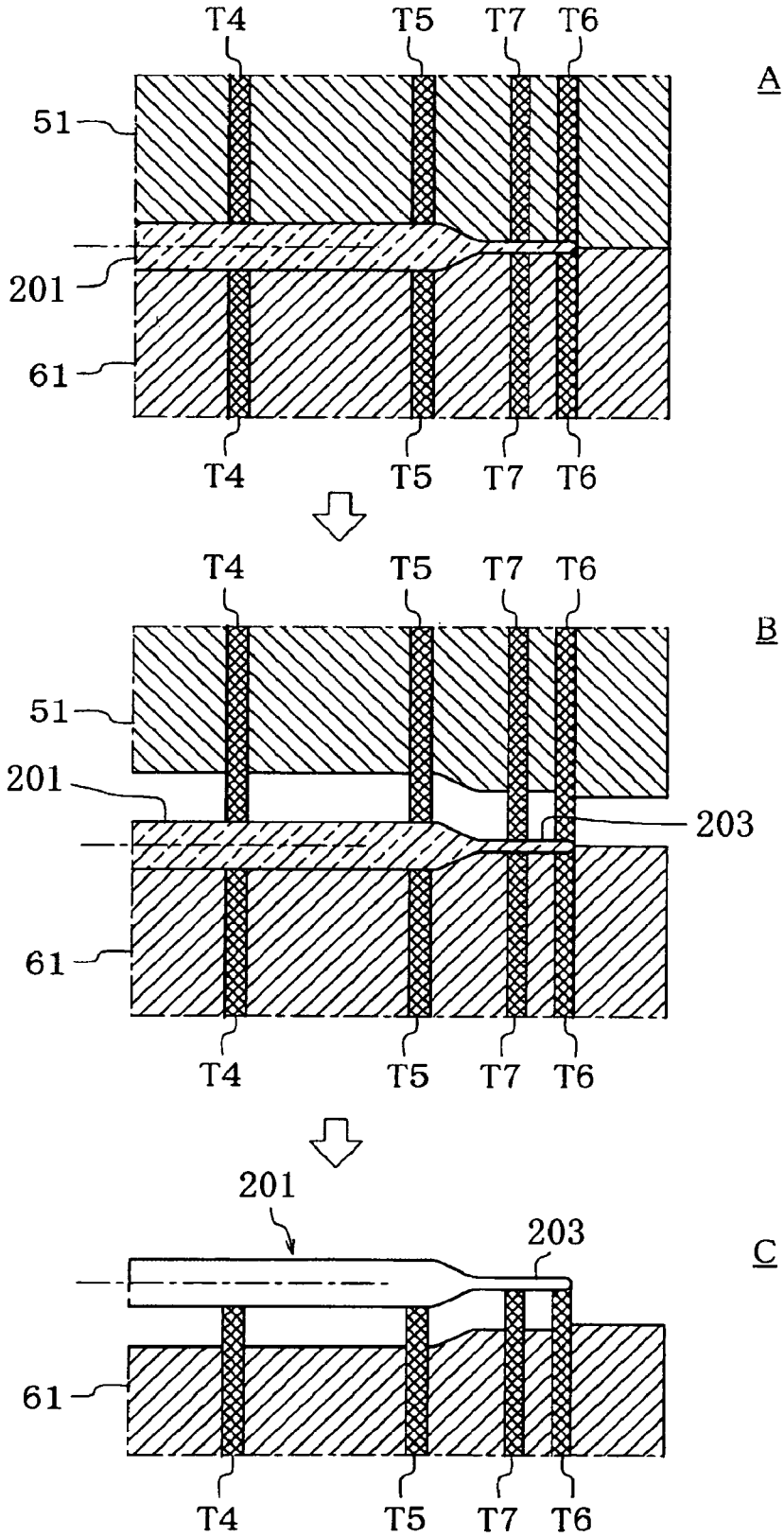
FIG. 6 is a section view illustrating steps of producing an unsintered resistor member, A is a view showing a state after dies are closed and injection is performed, B is a view showing a state in which an upper die is raised while ejector pins of the upper die remain to butt against the unsintered resistor member, and B is a view showing a state in which the upper die is raised to open the dies, and the unsintered resistor member is projected by ejector pins of a lower die, and from which the upper die is omitted.

Next, a method of producing the ceramic heater 1 of the invention will be described. First, the unsintered resistor member 103 is produced. Specifically, as shown in FIG. 6-A, molding dies 51, 61 overlap with each other, and the unsintered resistor member 103 is produced by injection molding. As shown in FIG. 6-B, then, the upper die 51 is raised to open the dies while pins T1 to T7 of the upper die 51 remain to be projected. As shown in FIG. 6-C, thereafter, the upper die (not shown) is raised together with the pins T1 to T7, and pins T1 to T7 of the lower die 61 are projected. Then, the unsintered resistor member 103 is separated from the molding dies 51, 61. At this time, also an unsintered heating portion 131 which will be formed as the heating portion is pushed out together with other portions. In FIG. 6, illustration of T1 to T3 is omitted. In the taking out of the unsintered resistor member 103, therefore, the unsintered heating portion 131 is not broken or bent, or a crack does not occur. Even when the thickness of the unsintered heating portion 131 is smaller than that of the ejector pins T6, T7 to be placed, therefore, it is possible to perform release of the unsintered heating portion 131. Consequently, the unsintered resistor member 103 in which the unsintered heating portion 131 is thin can be efficiently produced.

The thus formed unsintered resistor member 103 is embedded in an unsintered support 102 which has, for example, a columnar shape. Then, after predetermined thermal processes such as provisional sintering, the product is sintered by hot press, the outer peripheral face is ground, and the tip end (lower end) is finished into a hemispherical shape, thereby producing the ceramic heater 1.

Figure 7:
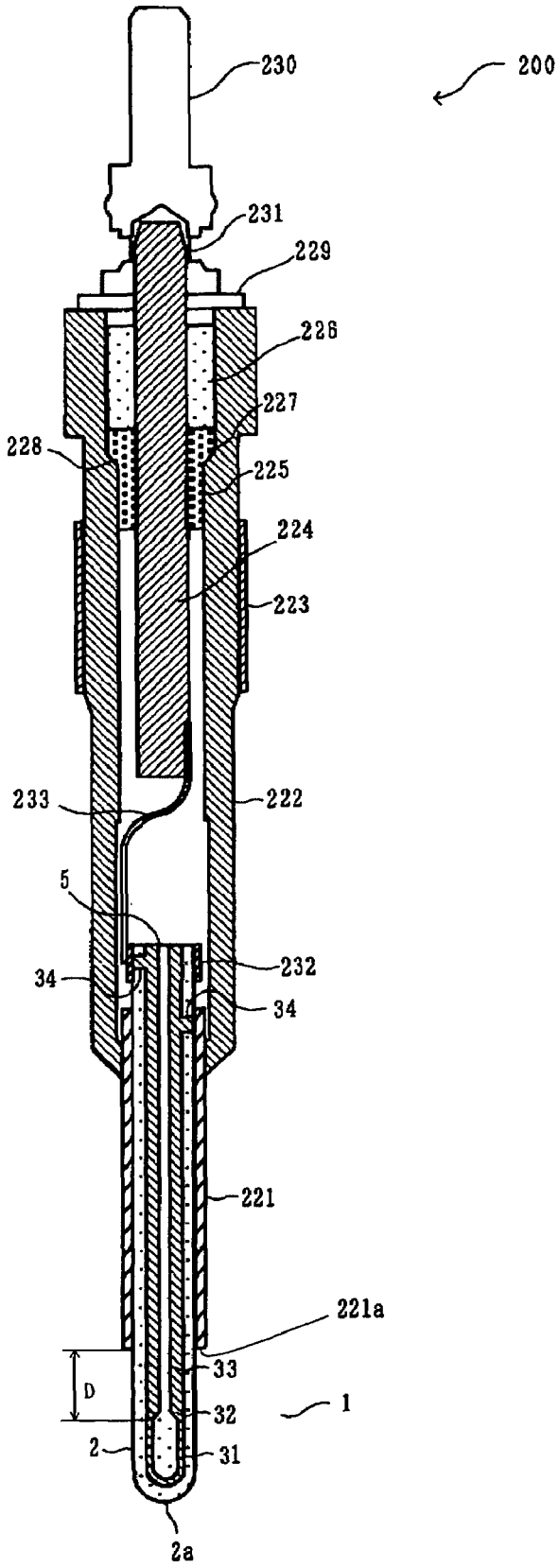
FIG. 7 is a section view showing the glow plug of the invention.

Next, the glow plug of the invention will be described. FIG. 7 shows a section structure of the glow plug 200. The outer peripheral face of the above-described ceramic heater 1 is circumferentially surrounded by a metal outer tube 221 so that at least the tip end 2*a* of the support 2 is projected, and the metal outer tube 221 is held with being circumferentially surrounded from the outside by a tubular metal shell 222 so that the tip end side of the metal outer tube is projected.

At this time, in the glow plug 200, the distance D in the direction of the axis O between the rear end of the heating portion 31 of the ceramic heater 1 and the tip end face 221*t* of the metal outer tube 221 is 5 mm. When the distance D is 2 mm or more in this way, it is possible to suppress the phenomenon that the metal outer tube removes heat generated from the heating portion of the ceramic heater, while the ceramic heater is reinforced by the metal outer tube. Therefore, heating can be efficiently performed.

In the outer peripheral face of the metal shell 222, a thread portion 223 serving as a mounting portion for fixing the glow plug 200 to an engine block which is not shown is formed. The metal shell 222 is fixed to the metal outer tube 221 by brazing or press fitting, or by laser welding the whole periphery of the tip end opening of the metal shell 222 and the outer peripheral face of the metal outer tube 221.

Inside the metal shell 222, a center shaft 224 for supplying an electric power to the ceramic heater 1 is placed from the rear end side of the metal shell in a state where it is insulated from the metal shell 222. For example, a ceramic ring 225 is placed between the outer peripheral face of the rear end side of the center shaft 224 and the inner peripheral face of the metal shell 222, and a glass filling layer 226 is formed in rear of the ring, thereby attaining the fixing. A ring-side engagement portion 227 is formed in the form of a large-diameter portion on the outer peripheral face of the ceramic ring 225, and engaged with a metal-side engagement portion 228 which is formed in the form of a circumferential step close to the rear end of the inner peripheral face of the metal shell 222, thereby preventing slipping-off in the forward axial direction.

A rear end portion of the center shaft 224 is elongated to the rear of the metal shell 222, and a terminal metal 230 is fitted onto the elongated portion via an insulation bush 229. The terminal metal 230 is fixed to the outer peripheral face of the center shaft 224 in a conductive state by a circumferential crimping portion 231.

By contrast, the resistor member 3 of the ceramic heater 1 is electrically connected to a ring member 232 in which one end is electrically connected to the metal outer tube 221, and the other end is inserted into the rear end side of the ceramic heater 1 by press fitting or the like. The ring member 232 and the center shaft 224 are electrically connected to each other by a lead member 233.

In the above, the structure of and the method of producing the ceramic heater and glow plug of the invention have been described in detail. The above-described structures and production methods are mere examples, and the invention is not restricted to them. The structure of and the method of producing ceramic heater and glow plug of the invention can be adequately changed in configuration without departing the spirit of the invention.

EXAMPLES

Example 1

First, samples of the unsintered resistor member 200 in which the projection 4 is disposed in the unsintered heating portion 231, and those in which the projection is not disposed were injection molded, and taken out from the molding dies. It was checked whether a defect such as a crack is caused in the unsintered heating portion 231 of each sample or not. Namely, samples of the unsintered resistor member 200 of the invention having the projection 4 in the unsintered heating portion 231 of the embodiment, and those of the unsintered resistor member 200 of a comparative example not having the projection 4 are produced. The samples of the invention were molded by the molding dies 51, 61 having the configuration in which, in the unsintered heating portion 231, the portion P7 of the projection 4 is pushed out by the ejector pin T7. The samples of the comparative example were molded by molding dies in which an ejector pin is not placed in a position corresponding to the above. Both the samples of the invention and those of the comparative example were produced while, in the unsintered heating portion 231, the ejector pin P6 was placed in the middle portion P6 of the folded part. Each of the used molding dies is of the type in which four samples can be obtained in one face, and 100 samples were produced by 25 shots. The check of a defect was performed in the following manner. After molding, the samples were dried at 200° C. for 50 minutes. Thereafter, the appearance check was performed with using a magnifying glass. A sample having a defect was counted as a defective. The result is shown in Table 1.

TABLE 1

| Projection | Defective |
|---|---|
| Exist (invention) | 1 |
| None (comparative example) | 30 |

As shown in Table 1, in the samples of the invention in which the projection 4 is in the unsintered heating portion 231, one of the samples was defective, and the yield was 99%. By contrast, in the comparative example in which no projection is formed in the unsintered heating portion 231, 30 samples were defective, and the yield was 70%.

Example 2

Next, the resistor member 3 made from a conductive ceramic and having the heating portion 31 and the pair of lead portions 33 which are continuously formed was embedded in the rod-shaped support 2 made from an insulative ceramic, to produce the ceramic heaters 1 of sample Nos. 1 to 6 which are configured as shown in FIG. 1. Using the ceramic heaters 1, glow plugs 20 for starting a diesel engine and having the configuration shown in FIG. 7 were produced.

The insulative ceramic constituting the support 2 was 96.5 ($0.89Si_3N_4$-$0.08Er_2O_3$-$0.01V_2O_5$-$0.02WO_3$)-$3.5MoSi_2$ (weight ratio). The conductive ceramic constituting the resistor member 3 was $70WC/30Si_3N_4$-$3.96Er_2O_3$-$1.61SiO_2$ (weight ratio).

Figure 8:
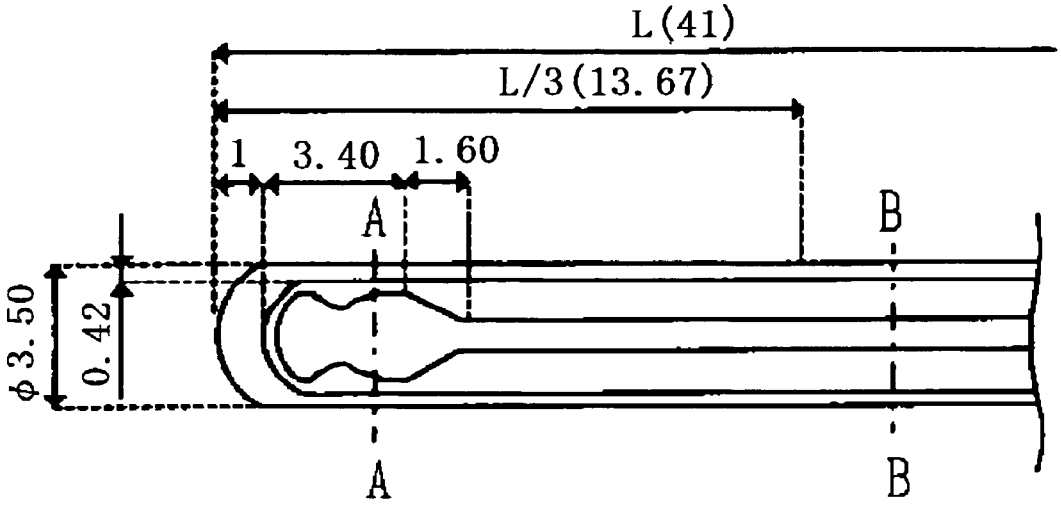
FIG. 8 is a section view showing an example of production of a ceramic heater.
Figure 9:
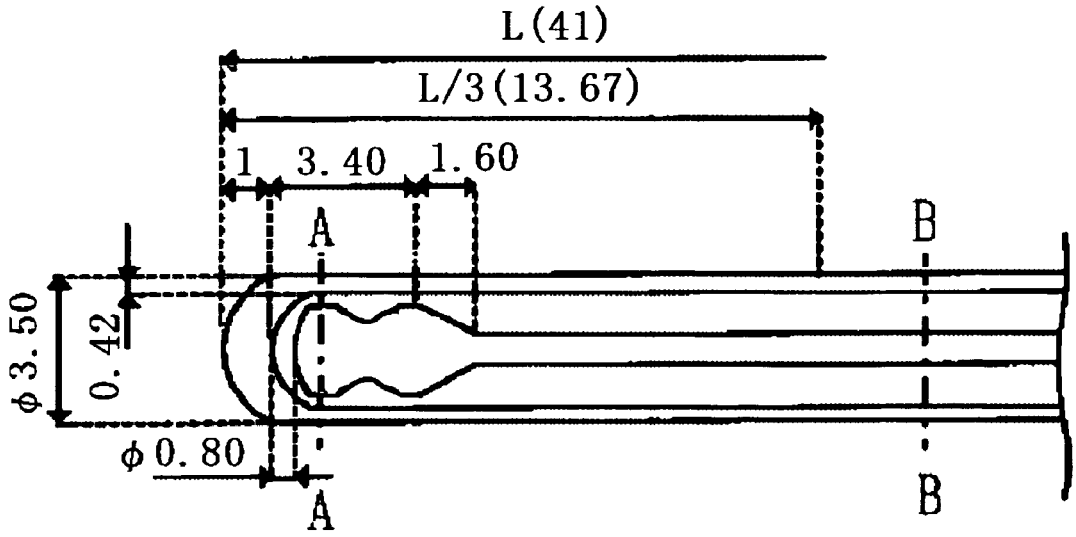
FIG. 9 is a section view showing an example of production of the ceramic heater.
Figure 10:
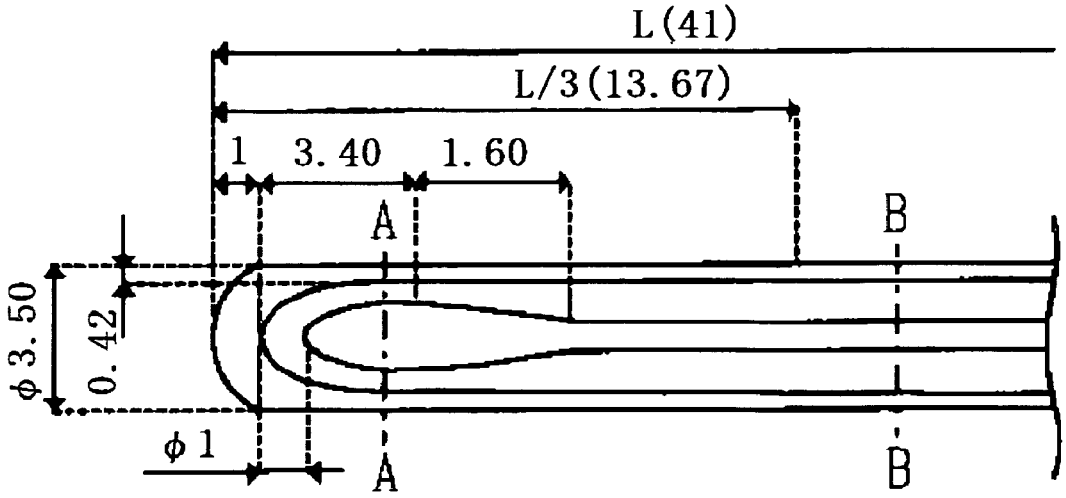
FIG. 10 is a section view showing an example of production of the ceramic heater.

The section shapes in the longitudinal direction of the ceramic heaters 1 of sample Nos. 1 to 6 were three kinds of section shapes shown in FIGS. 8 to 10. Sample Nos. 1 and 5 had the shape shown in FIG. 8, sample Nos. 2 and 3 had the shape shown in FIG. 9, and sample Nos. 4 and 6 had the shape shown in FIG. 10. The units of values of portions in FIGS. 8 to 10 are (mm). The sectional areas in the section A-A of the heating portions 6 of the ceramic heaters 1 of sample Nos. 1 to 6, and those in the section B-B of the lead portions 7 were set as shown in Table 2.

TABLE 2

| | | Element diagram | Sectional area of heating portion ($mm^2$) | Sectional area of lead portion ($mm^2$) |
|---|---|---|---|---|
| Sample | 1 | FIG. 8 | 0.08 | 1.8 |
| | 2 | FIG. 9 | 0.18 | 2.0 |
| | 3 | FIG. 9 | 0.18 | 1.8 |
| | 4 | FIG. 10 | 0.40 | 1.7 |
| | 5 | FIG. 8 | 0.04 | 1.8 |
| | 6 | FIG. 10 | 0.62 | 1.7 |

In the ceramic heaters 1 of sample Nos. 1 to 6, the total resistance (R1) of the resistor member 3, the resistance (R2) of a portion of the resistor member included in the range from the tip end of the support to ⅓ of the total length of the support, with respect to the resistance of the resistor member, and a resistance ratio (R2/R1) were as shown in Table 3.

TABLE 3

| | | Resistance of resistor member (mΩ) | Resistance of heating portion (mΩ) | Resistance of heating portion/ resistance of resistor member (mΩ) |
|---|---|---|---|---|
| Sample | 1 | 538 | 428 | 0.80 |
| | 2 | 249 | 148 | 0.59 |
| | 3 | 277 | 168 | 0.61 |
| | 4 | 227 | 110 | 0.48 |
| | 5 | 712 | 603 | 0.85 |
| | 6 | 206 | 89 | 0.43 |

In the glow plugs 20 of sample Nos. 1 to 6, the power consumption when the glow plugs were heated to 1,250° C., and the maximum heating temperature per W of the power consumption were measured. The results are shown in Table 4.

TABLE 4

| | | Resistance of resistor member (mΩ) | Power consumption in heat generation of 1,250° C. (W) | Heating temperature per W (° C./W) |
|---|---|---|---|---|
| Sample | 1 | 538 | 41.7 | 30.0 |
| | 2 | 249 | 50.8 | 24.7 |
| | 3 | 277 | 48.3 | 25.9 |
| | 4 | 227 | 67.9 | 18.4 |
| | 5 | 712 | 40.7 | 30.7 |
| | 6 | 206 | 78.1 | 16.0 |

The measurements of the maximum heating temperature, the power consumption, and a 1,000° C.-reaching time period at an application of 11 V which will be described later were performed with using an apparatus shown in FIG. 11. Namely, an applied voltage was set by a controller 40, whereby a DC power source 41 was controlled and the voltages applied to the glow plugs 20 were controlled. The temperatures of the tip end portions of the ceramic heaters 1 of the glow plugs 20 were measured by a radiation thermometer 44 consisting of a camera 42 and a body 43 (the emissivity of 0.935). The applied voltage and current from the DC power source 41 were monitored by an oscilloscope 45, and the measured temperature of the radiation thermometer 44 was monitored. The oscilloscope 45 uses the applied voltage as a trigger, and synchronizingly records data of the measured temperature, the applied voltage, and the current. The obtained data were edited by a personal computer 46 to obtain the power consumption, the 1,000° C.-reaching time period, and the like. Table 5 shows the detail of the apparatus.

TABLE 5

| Name | Type | Manufacturer | Detail |
|---|---|---|---|
| 40 Controller | GROW PLUG TEST CONTROLLER | NIPPO ELECTRONIC IND. LTD. | TYPE GPT-FIB |
| 41 DC power source | EX-750L2 | TAKASAGO | EXTENDED RANGE DC POWER SUPPLY |

TABLE 5-continued

| | Name | Type | Manufacturer | Detail |
|---|---|---|---|---|
| 42 | Radiation thermometer | INFRARED THERMOMETER | IRCON | MODLINE 6000SERIES |
| 43 | Body of radiation thermometer | INFRARED THERMOMETER | IRCON | MODLIE PLUS |
| 45 | Oscilloscope | DL710 16CH DIGITAL SCOPE | YOKOGAWA | SUFFIX M-NJ/M1/C10 |
| 46 | Personal computer | NEC VersePro GenuineIntel X68 Family 6 Model 8 Stepping 3 | NEC | OS: Microsoft Windows 98 Second Edition MODEL701830 |

Then, the energization durability test was conducted on the glow plugs 20. The test temperature in the energization durability test was set by adjusting the applied voltage, to 1,350° C. which is the limit temperature of the heat resistance. In energization, energization for one minute and energization suspension (during which forced cooling is performed by compressed air) for 30 seconds were set to one cycle, and this cycle was repeated. The upper limit of the number of energization cycles was set to 50,000 cycles. When the resistance was changed by 10% or more, the test was ended at that timing. The glow plugs 20 were attached to an actual diesel engine, and a test of starting the diesel engine was performed to measure the time period elapsed until blow-up.

In the diesel engine starting test, the environmental temperature was −7° C., and the pre-glow time was 10 seconds. The blow-up was set as a timing when the rotation number reaches 80% of the idling rotation number. Table 6 shows results.

TABLE 6

| | | Energization duration cycle (number) | Blow-up time (sec) |
|---|---|---|---|
| Sample | 1 | >50,000 | 2.5 |
| | 2 | >50,000 | 2 |
| | 3 | >50,000 | 2.3 |
| | 4 | >50,000 | 1.6 |
| | 5 | >50,000 | 4.1 |
| | 6 | 39,250 | 1.4 |

With respect to sample Nos. 1 to 4 and 6, the blow-up time was 1.4 to 2.5 seconds and excellent. With respect to sample No. 5, the blow-up time was 4.1 seconds, and it was noted that the starting property is slightly inferior to the other samples. By contrast, with respect to sample Nos. 1 to 5, the energization duration cycle exceeded 50,000, and the durability was excellent. With respect to sample No. 6, the energization duration cycle was 39,250, and it was noted that the energization duration cycle is slightly inferior to the other samples.

From the above, when the heating temperature per W is 18.4 to 30.0° C./W, a glow plug which is excellent in both energization durability and starting property can be obtained. When the ratio (R2/R1) of the resistance of the heating portion to that of the resistor member is 0.48 to 0.80, a glow plug which is excellent in both energization durability and starting property can be obtained.

Example 3

Next, in order to check influences on the resistance (R1) of the resistor member 3, ceramic heaters which are identical in material and shape with the ceramic heater 1 produced in sample No. 2 were produced while the resistance (R1) of the resistor member 3 was changed by changing the sintering temperature in the range of 1,700 to 1,800° C. At this time, the resistance (R1) of the resistor member 3 was 249 to 478 mΩ. Using the ceramic heaters 1, glow plugs 20 of sample No. 7 to 10 for starting a diesel engine were produced.

In the glow plugs 20, the power consumption when the glow plugs were heated to 1,250° C., the heating temperature per W, and the 1,000° C.-reaching time period at an application of 11 V were measured. The results are shown in Table 7.

TABLE 7

| | | Sintering temperature (° C.) | Resistance of resistor member (mΩ) | Power consumption in heat generation of 1,250° C. (W) | Heating temperature per W (° C./W) | 1,000° C.-reaching time period at application of 11 V (sec.) |
|---|---|---|---|---|---|---|
| Sample | 7 | 1,700 | 478 | 50.5 | 24.7 | 2.5 |
| | 8 | 1,720 | 420 | 50.9 | 24.5 | 2 |
| | 9 | 1,750 | 331 | 50.4 | 24.8 | 1.3 |
| | 10 | 1,800 | 249 | 50.6 | 24.7 | 0.7 |

As shown in Table 7, the power consumptions when the glow plugs were heated to 1,250° C. were substantially identical with one another, and also the heating temperatures per W were substantially identical with one another. In such a case, as apparent from Table 6, the 1,000° C.-reaching time periods in sample Nos. 8 to 10 were 2 seconds or less, and excellent. In sample No. 7, the 1,000° C.-reaching time period was 2.5 seconds, and it was noted that the time period is slightly inferior to the other examples. Namely, it was ascertained that, when the resistance (R1) of the resistor member 3 is 420 mΩ or less, a glow plug in which the temperature can be rapidly raised can be obtained.

Example 4

Next, ceramic heaters 1 in which the sectional area (S1) of the heating portion 31 of the resistor member 3 in each ceramic heater 1, the sectional area (S2) of the lead portions 33, and the ratio (S1/S2) of the sectional area (S1) of the heating portion 31 to the sectional area (S2) of the lead portions 33 were set as shown in FIG. 8, and other dimensions and the like were set as sample No. 1 were produced. The ceramic heaters were attached to the glow plugs 20.

Figure 11:
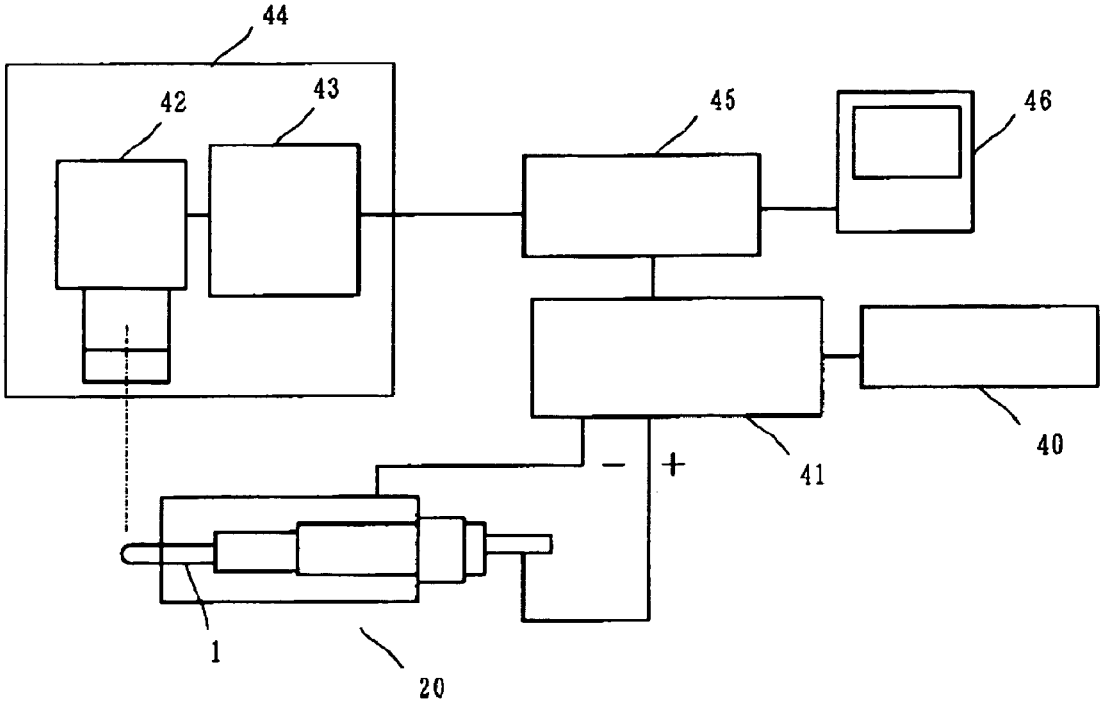
FIG. 11 is a diagram showing a method of measuring a heating temperature and a consumption power.

With respect to the glow plugs 20, the resistance at room temperature, the saturation temperature, the difference (Δt) at the saturation temperature between the maximum temperature and the minimum temperature of the outer peripheral face in a section which is perpendicular to the axial direction, and the power consumption were measured with using the apparatus shown in FIG. 11. The results are shown in Table 8.

The above-described energization durability test was conducted on the glow plugs 20. Table 8 shows also the results.

TABLE 8

| | | Sectional area | | Sectional | Length between small-diameter portion and large-diameter portion | Performance | | | | Energization durability |
|---|---|---|---|---|---|---|---|---|---|---|
| | | Heating portion a ($mm^2$) | Lead portion A ($mm^2$) | area ratio a/A | L (mm) | Resistance at room temp. (mΩ) | Saturation temp. (° C.) | Δt (° C.) | Power consumption (W) | test 1,350° C. (cycle) |
| Sample | 11 | 0.07 | 1.77 | 1/25.3 | 5 | 603 | 1,211 | 73 | 37.3 | >50,000 |
| | 12 | 0.20 | 1.77 | 1/8.85 | 5 | 311 | 1,204 | 54 | 44.5 | >50,000 |
| | 13 | 0.38 | 1.77 | 1/4.66 | 5 | 227 | 1,205 | 38 | 56.6 | >50,000 |
| | 14 | 0.50 | 1.77 | 1/3.54 | 5 | 208 | 1,203 | 35 | 64.1 | >50,000 |
| | 15 | 0.64 | 1.77 | 1/2.77 | 5 | 195 | 1,199 | 32 | 71.7 | >50,000 |
| | 16 | 0.79 | 1.77 | 1/2.24 | 5 | 186 | 1,200 | 29 | 83.9 | 3,5000 NG. |

As apparent from Table 8, in samples in which the ratio (S1/S2) of the sectional area (S1) of the heating portion 31 to the sectional area (S2) of the lead portions 33 is close to 1/25.5, the difference (Δt) between the maximum temperature and the minimum temperature is large, but the power consumption is suppressed. As the ratio is closer to 1/2.6, the power consumption is larger, but it was noted that the difference (Δt) between the maximum temperature and the minimum temperature is smaller. Furthermore, it was ascertained that, when the ratio exceeds 1/2.6, the energization durability is remarkably lowered. From these, it was ascertained that, in order to obtain a glow plug in which the power consumption is suppressed, the difference (Δt) between the maximum temperature and the minimum temperature is small, and the energization durability is excellent, the ratio (a/A) of the sectional area (S1) of the heating portion 31 to the sectional area (S2) of the lead portions 33 is preferably set to be 1/2.6 to 1/25.5.

While the invention has been described in detail and with reference to the specific embodiments, it is obvious to those skilled in the art that various changes and modifications may be applied without departing from the sprit and scope of the invention.

This application is based on Japanese Patent Application (No. 2004-112721) filed Apr. 7, 2004, Japanese Patent Application (No. 2004-118) filed Apr. 13, 2004, and Japanese Patent Application (No. 2004-199602) filed Jul. 6, 2004, and their disclosure is incorporated herein by reference.

What is claimed is:

1. A ceramic heater comprising: a rod-shaped support extending in an axial direction, and comprising an insulative ceramic; and a resistor member including a heating portion embedded in a tip end part of said support, and a pair of lead portions comprising: one end which is connected to said heating portion; another end which is exposed from a rear end of said support; and a terminal part which is exposed from an outer circumferential face of said support, wherein said heating portion and said lead portions including the terminal part comprise a same conductive ceramic.

2. The ceramic heater according to claim 1, wherein a maximum heating temperature per W is 18.4 to 30.0 (° C./W).

3. The ceramic heater according to claim 1, wherein a ratio of a resistance of a portion of said resistor member included in a range from a tip end of said support to ⅓ of a whole length of said support to a resistance of said resistor member is from 0.48 to 0.80.

4. The ceramic heater according to claim 1, wherein a resistance of said resistor member at 25° C. is 420 mΩ or less.

5. The ceramic heater according to claim 1, wherein a sectional area S1 of said heating portion is smaller than a sectional area S2 of said lead portions.

6. The ceramic heater according to claim 5, wherein a minimum sectional area S1 of said heating portion is in a range of 1/2.6 to 1/25.5 with respect to the sectional area S2 of said lead portions.

7. The ceramic heater according to claim 5, wherein said heating portion has a pair of connecting portions extending in an axial direction, and connecting respectively to said pair of lead portions, and a center axis of one of said connecting portions is positioned outside a center axis of one of said lead portions which is continuous to said connecting portion.

8. A ceramic heater comprising: a rod-shaped support extending in an axial direction, and comprising an insulative ceramic; and a resistor member including a heating portion embedded in a tip end part of said support, and a pair of lead portions extending from said heating portion toward a rear end side of said support, wherein said heating portion and said lead portions comprise a same conductive ceramic, said ceramic heater has, in a part of said heating portion, a flat part in which a width w of said heating portion in a section of said heating portion is larger than a thickness h of said heating portion perpendicular to the width, and larger than a width of another portion of said heating portion and wherein said flat part has a projection which is formed by inwardly projecting a part of said heating portion.

9. The ceramic heater according to claim 8, wherein when said heater is cut by a section passing center axes of said lead portions, said projection is disposed inside said heating portion.

10. A glow plug comprising a ceramic heater, wherein a ceramic heater according to claim 1 is used.

11. The glow plug according to claim 10, wherein said glow plug comprises:

a metal outer tube which allows said heating portion of said ceramic heater to be projected, and which circumferentially surrounds said heating portion; and a metal shell which allows a tip end side of said metal outer tube to be projected, and which holds said metal outer tube, and an axial distance D between a rear end of said heating portion and a tip end face of said metal outer tube is equal to or longer than 2 mm.

12. A method for producing a ceramic heater including: a rod-shaped support containing an insulative ceramic; and a resistor member including a heating portion embedded in a tip end part of said support, and a pair of lead portions extending from said heating portion toward a rear end side of said support, wherein a sectional area S1 of said heating portion is smaller than a sectional area S2 of said lead portions, a part of said heating portion has a flat part in which a width w of said heating portion in a section of said heating portion is larger than a thickness h of said heating portion perpendicular to the width, and said method comprises:

injection molding an unsintered resistor member by using molding dies, said unsintered resistor member being made from a same conductive ceramic material, and formed as said resistor member after sintering;

butting ejector pins against, in said unsintered resistor member, an unsintered flat part which is formed as said flat part after sintering and unsintered lead portions which are formed as said lead portions after sintering, so as to remove from said molding dies;

embedding said unsintered resistor member in an unsintered support which is formed as said support after sintering; and sintering said unsintered support in which said unsintered resistor member is embedded.

13. The method for producing a ceramic heater according to claim 12, wherein said ejector pins include: a first ejector pin which is closest to said unsintered heating portion among said ejector pins that are to butt against said unsintered lead portions; a second ejector pin which is to butt against said unsintered flat part that is adjacent to said first ejector pin; and a third ejector pin which butts against said unsintered lead portion that is adjacent to said first ejector pin, and an axial distance between said first ejector pin and said second ejector pin is shorter than an axial distance between said first ejector pin and said third ejector pin.

14. The ceramic heater according to claim 1, wherein each of the heating portion and the lead portions has an oval section shape.

15. The ceramic heater according to claim 8, wherein each of the heating portion except for the flat part and the lead portions has an oval section shape.

* * * * *